United States Patent [19]

Hynes

[11] Patent Number: 4,953,342

[45] Date of Patent: Sep. 4, 1990

[54] MULTI PACKAGE CONTAINERS

[76] Inventor: Charles M. Hynes, 10116 Shiller Blvd., Franklin Park, Ill. 60131

[21] Appl. No.: 193,199

[22] Filed: May 9, 1988

Related U.S. Application Data

[62] Division of Ser. No. 394,200, Jul. 1, 1982, abandoned.

[51] Int. Cl.[5] ..... B65B 27/04; B65B 35/44

[52] U.S. Cl. ..... 53/398; 53/443; 53/449

[58] Field of Search ..... 53/398, 399, 443, 449, 53/176, 441, 48, 291, 293, 556, 580, 582, 585

[56] References Cited

U.S. PATENT DOCUMENTS

| | | | |
|---|---|---|---|
| 2,815,627 | 12/1957 | Eddison | 53/291 |
| 2,864,212 | 12/1958 | Bruce | 53/585 X |
| 3,085,377 | 4/1963 | Ganz | 53/48 X |
| 3,383,828 | 5/1968 | Cunningham | 53/48 X |
| 3,404,505 | 10/1968 | Hohl et al. | 53/48 X |
| 3,447,280 | 6/1969 | Cunningham et al. | 53/48 |
| 3,714,756 | 2/1973 | MacInnes et al. | 53/585 X |
| 3,742,677 | 7/1973 | Best | 53/48 X |
| 3,760,554 | 9/1973 | Arneson | 53/48 X |
| 3,816,968 | 6/1974 | Morgan et al. | 53/48 |
| 4,070,850 | 1/1978 | Cunningham | 53/48 |
| 4,387,553 | 1/1983 | Strub et al. | 53/585 |
| 4,501,104 | 2/1985 | Griffin et al. | 53/176 X |

FOREIGN PATENT DOCUMENTS

| | | | |
|---|---|---|---|
| 0024451 | 3/1981 | European Pat. Off. | 53/48 |

*Primary Examiner*—Horace M. Culver
*Attorney, Agent, or Firm*—Thomas Buckman

[57] ABSTRACT

A packaging machine for continuously feeding a predetermined array of containers at predetermined speeds beneath an endless series of jaw stations designed to slowly stretch bands and telescopically associate the stretched bands with an associated array while minimizing length of travel of the arrays through the machine.

4 Claims, 3 Drawing Sheets

MULTI PACKAGE CONTAINERS

This application is a continuation of application Ser. No. 394,200, filed July 1, 1982 now abandoned.

Background and Summary of the Invention

Prior art machines for continuous applications of multi-packaging devices to containers are well known and may be generally shown as an example in U.S. Pat. Nos. 3,383,828; 3,775,935 and 4,079,571. Machines shown in these patents are typically involved with the high speed application of a multi-packaging device which engages the upper section of cans to integrate a plurality of cans into a package. Likewise there have been attempts to create a package by placing a resilient band about the periphery of an array of containers, examples of such devices are shown in U.S. Pat. Nos. 3,404,505 and 3,714,756. A package which combines the features of the can top securing carrier devices and array confining band devices has been developed which creates a superior multi-package for a larger array of containers. For example, a package created by the aforementioned machine, U.S. Pat. No. 4,079,571, creates an array of 12 cans in a four rank by three row configuration. It has been found advantageous to further stabilize and integrate such a package by a critically designed resilient band which includes a handle. An example of such a package is shown in U.S. Pat. No. 4,269,308 which is incorporated herein by reference. The machine of the instant application is designed to create such a stable package in an efficient manner.

It is an object of this invention to provide a machine for placing a package creating band about an array of containers while the arrays are continuously fed through the machine.

A further object of the invention is to provide a machine for creating a multi-package which incorporates a band about the periphery of the array in an efficient manner without overly stressing the band while minimizing the length of the stretching path in the machine.

A further advantage of this machine is the use of a plurality of conveyor systems for continuously moving the array to be packaged toward the package making device longitudinally of the machine while the array and device are telescopically associated, thus reducing the length of the machine.

The objects and advantages of this invention are achieved by a machine having continuously moving primary conveyor for handling arrays of containers being fed through the machine in conjunction with a continuously moving endless series of jaw members which is designed to first accept a device at one elevation of the machine, to secondly gradually deform the device by stretching utilizing a plurality of jaws which are cam driven to a stretched configuration which is slightly larger than the array, and thirdly, insuring that the stretched device is registered above the array so that the array and device may be telescoped together through a combination of changes in elevation of the jaws and the array feeding conveyor.

Other objects and features of the invention will be apparent upon perusal of the hereinafter following detailed description read in conjunction with the drawings.

DETAILED DESCRIPTION OF THE PREFERRED EMBODIMENT

To facilitate the understanding of machine 10, a brief synopsis of the basic sections of the machine followed by a more detailed analysis of each of the general sections of the machine appears to be appropriate.

Figure 1:
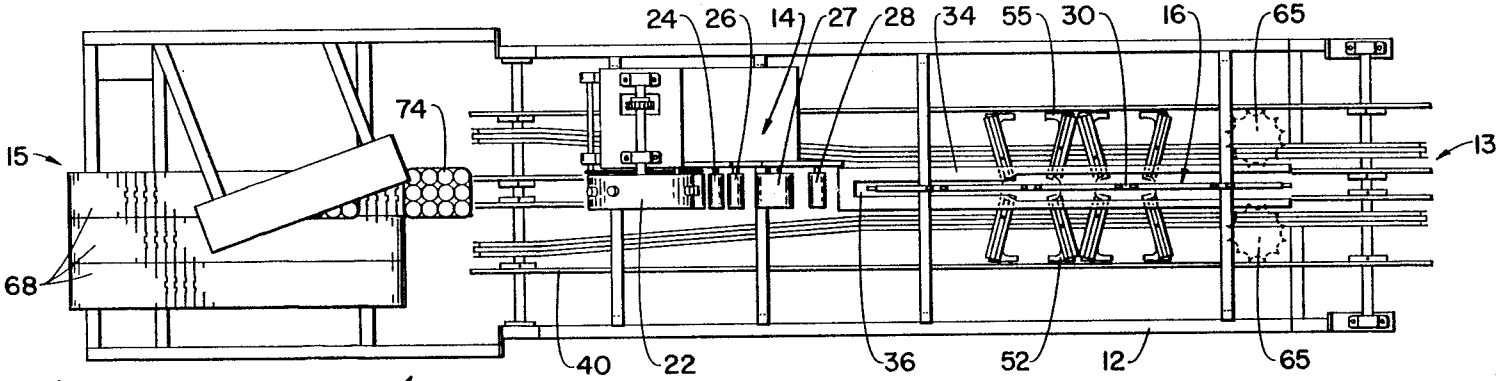
FIG. 1 a top plan view of the applicating machine embodying the subject invention.
Figure 2:
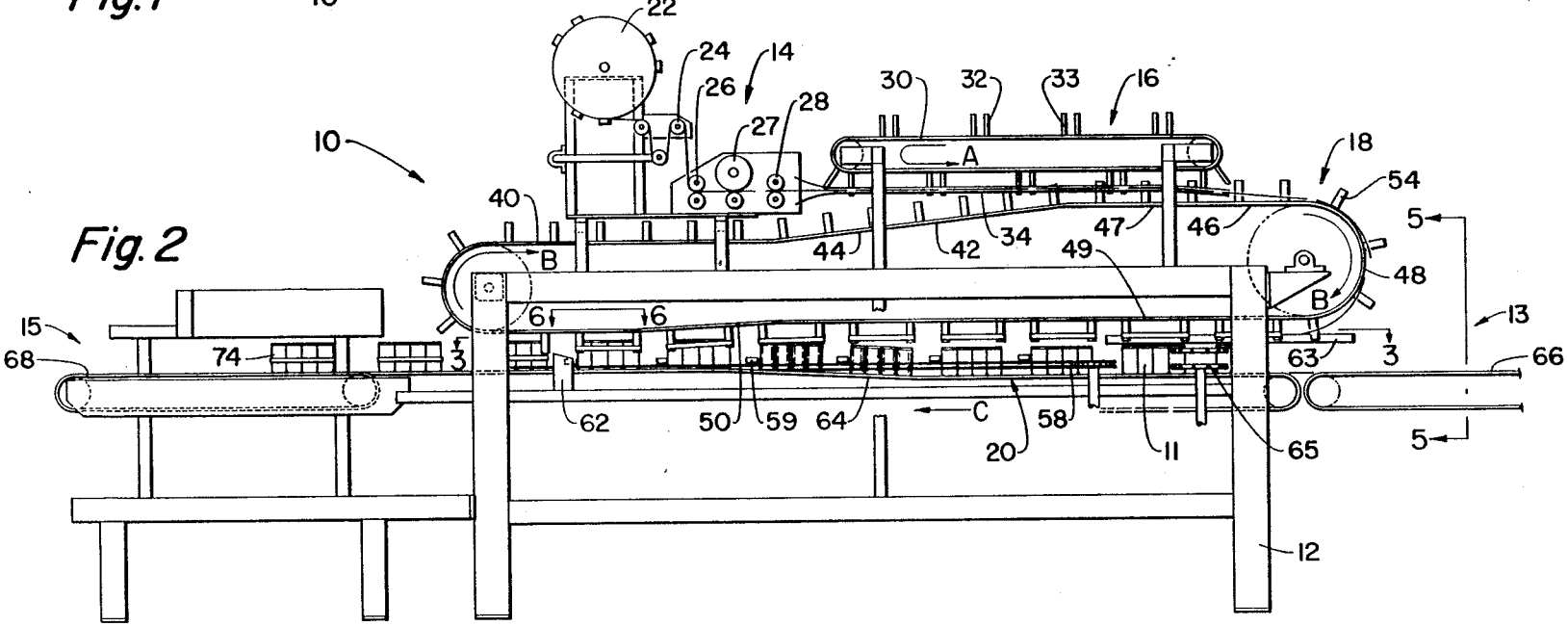
FIG. 2 is a side elevational view of the machine of FIG. 1.
Figure 3:
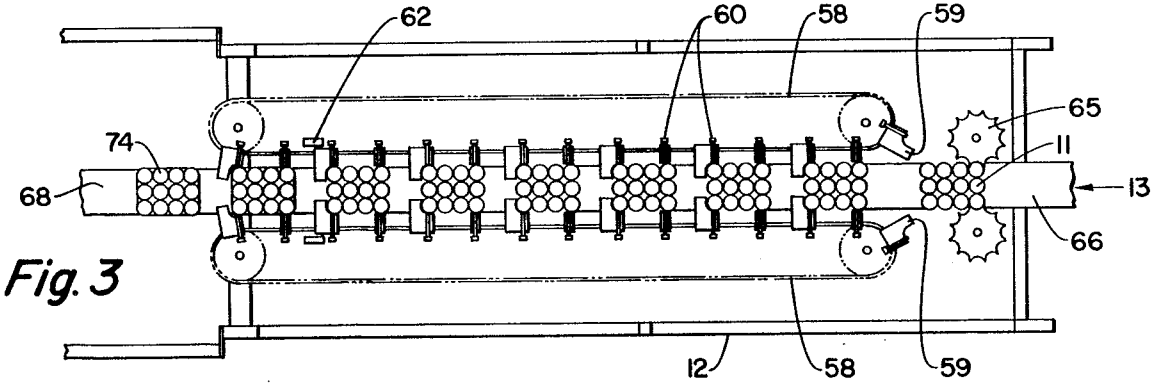
FIG. 3 is a longitudinal sectional view of the machine as taken along lines 3—3 of FIG. 2.

Turning to FIGS. 1 and 2, the machine includes a base or frame 12 which supports a carrier strip feeding system 14, a first carrier strip guiding conveyor system 16, a second carrier strip conveying and stretching system 18 and a third conveyor system 20 which continuously moves the array of containers through the machine from an entry end 13 to an exit end 15.

A continuous flow of cans 11 are fed to the entry end 13 of the machine by an in-feed conveyor 66. These cans 11 are preferably configured in a 12 can array of 4 ranks and 3 rows by a primary packaging carrier 75, which may be either a single carrier or a pair of carriers as described in the above noted U.S. Patent 4,269,308. The machine covered by 4,269,308 is shown in block diagram in FIG. 2. As will be discussed further herein a secondary packaging device 70 is to be applied around the Periphery of the array to create a stable unitized package 74.

The secondary packaging devices 70 which are to be applied by machine 10, are preferably interconnected in end-to-end fashion and carried on a reel 22 which may be fed to the first conveyor system 16 through the carrier feed system 14. This carrier feed system may typically include a series of guiding tensioning and stabilizing rollers 24 and a series of nip rollers which will separate a continuous strip of carrier devices 70 into discrete carriers. This is done in this embodiment through differential speed rollers which are shown as roller sets 26 and 27. Roller set 27 is designed to rotate at a speed greater than set 26 which causes tension between the two roller sets thus separating the carriers serially from one another, facilitated by scored regions in the strip. After each carrier 70 has been so separated, they are fed through stabilizing roller set 28 into a first conveyor system 16.

Conveyor 16 is designed to uniformly guide the discrete devices to stretching jaws which will be described later herein. The conveyor 16 is basically an endless chain 30 which carries a plurality of pairs of posts 32 and 33. This conveyor 16 is designed to rotate in a counterclockwise direction as shown by arrow A. The pair of posts are spaced from one another so that front post 32 of each set will engage the front end of the aperture of the device 70 pulling it toward the entry end of the machine and back post 33 of each set thus being inserted adjacent the rear extremity of the aperture in the device. As shown in FIG. 2, the back post 33 also serves as a stop for the next carrier to be handled by this conveyor as it is fed into system 16 by feed system 14. The post sections 32, 33 merely serve to move the carrier longitudinally of the machine and do not stress or change the configuration of the strip generally shown in FIG. 4. These posts are thus used in conjunction with a tray 34 which engages the upper and lower margins of the devices 70 and maintains the devices at a predetermined elevation of the machine while post 30, 32 are permitted to continue their longitudinal path by virtue of a slot 36 formed in the tray.

While the device 70 is lightly or loosely carried from the feed system towards the entering end of the machine, the second conveyor system 18 is operating to continuously feed jaw stations 52 into telescopic arrangement with the devices. These jaw stations will be shown in detail in FIG. 5 and are mounted on pairs of chain conveyors 40 situated on either side of the center line of the machine. The chain conveyors 40 rotate in a clockwise direction as shown by arrow B and are also configured to change elevations as clearly shown in FIG. 2. The elevation changes are determined by guide frame 42 which includes an in-feed section 44 which brings the jaws up from a first elevation into telescopic association with the unstretched devices and a stretching and stabilizing section 46 which, as shown in FIG. 2, includes a top elevation section 47, a curvature section 48, which changes the direction of movement of the carrier from a direction toward the entry end to a direction toward exit end of the machine, and a lower stretching section 49. The carrier off-feed section 50 will be described later herein in conjunction with the container carrier conveying system 20.

Figure 6:
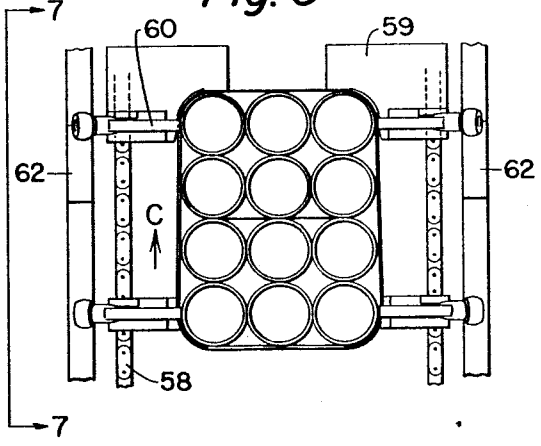
FIG. 6 is an enlarged plan view of a stripping station as viewed in a direction of lines 6—6 of FIG. 2.
Figure 8:
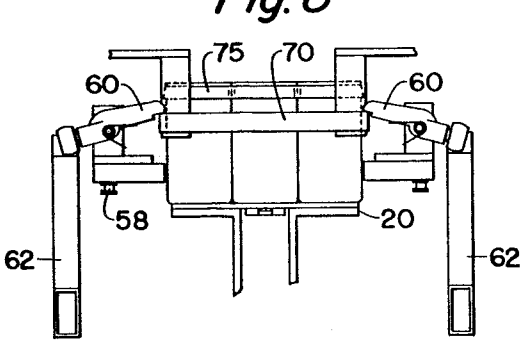
FIG. 8 is an enlarged end elevational view of the front end of the stripper station as taken in direction of line 8—8 of FIG. 7.
Figure 9:
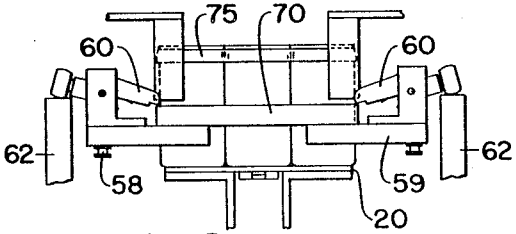
FIG. 9 is an enlarged end elevational view of the rear of the stripper station taken in the direction of line 9—9 of FIG. 7.
Figure 7:
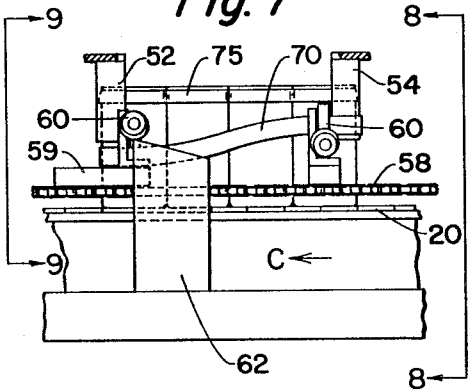
FIG. 7 is an enlarged side elevational view of the stripper station as taken in the directions of line 7—7 in FIG. 6.
Figure 5:
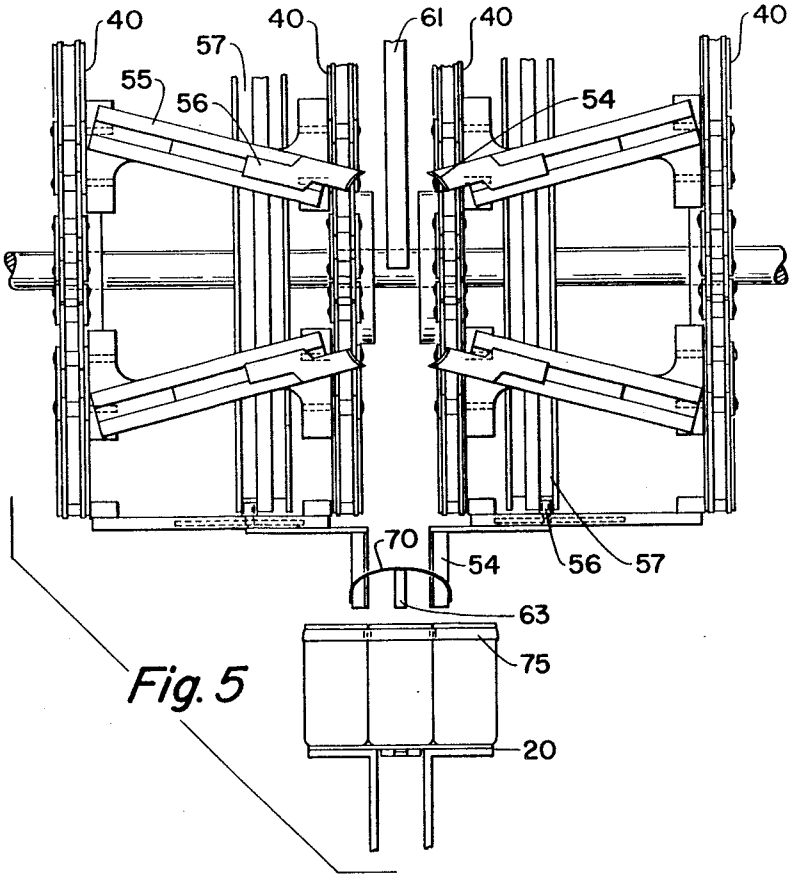
FIG. 5 is an enlarged end elevational view of the machine as taken in the direction of line 5—5 of FIG. 2.

Each jaw station includes four arcuate shaped upstanding jaws 54 and their associated jaw carrying bases 55. Each jaw is moved in a linear direction relative to their bases by a slide and a cam follower means 56. The cam followers as will be seen by the drawings, are controlled by a pair of cam tracks 57 to selectively move the jaws closer to the center line, which constitutes the closed position, or, away from the center line which constitutes an open position. The open position present in section 49 of the conveyor 18 is maintained through section 50. As shown in FIGS. 1, 5, and 6, the jaws are configured to essentially define the corners of a rectangle. The open position of the jaw stations defining a rectangle slightly larger in parameter than the parameter of the array of containers to be packaged.

Figure 4:
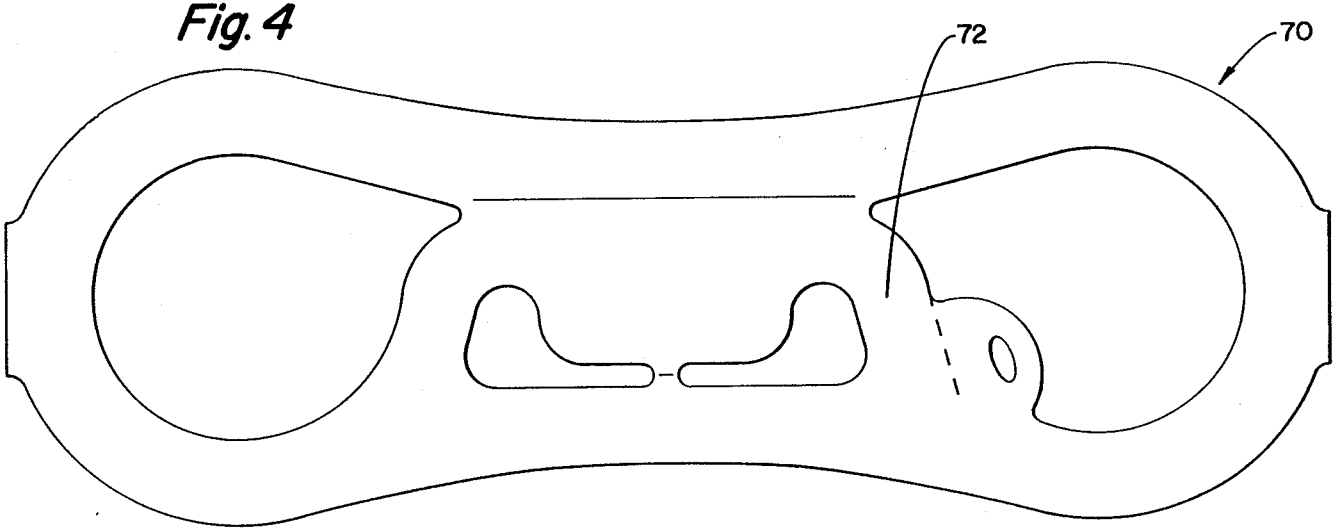
FIG. 4 is a plan view of a package making device to be applied to an array of containers by the applicating machine of this invention.

As indicated from the reference patent 4,269,308 and FIG. 4, an integral handle 72 is provided on the device 70. It is important that this handle be disposed in consistent manner relative to the tops of the cans, i.e. either directed upwardly or downwardly, and thus a handle orienting or guide bar 63 is positioned at the mouth of the entry end 13 of the machine and adjacent curved section 48 and lower stretching section 49. As shown in FIG. 5 this bar 63 uniformly orients the direction in which the bands will move to change from a planar condition to a condition where the band is flat against the periphery of the array and against the arcuate jaw surfaces.

In order to insure that the stretched bands 70 are associated with the array of cans in the shortest possible distance and yet not create an abrupt stretching technique, the jaws carrying the band, as well as the array to be assembled, move toward one another while both of these elements are continuously moving towards the exit end of the machine. Thus it will be shown that section 50 of the jaw conveyor means changes its elevation downwards toward the conveyor 20 at the same time as conveyor 20 changes its elevation upwardly toward the jaw carrying conveyor 18. The arrays of cans 11 are continuously fed by the conveyor 20 after they have been metered into the entry end by starwheel means 65. The arrays however change their elevation from the entry end by virtue of ramp section 64.

A further conveyor means in the form of a set of chain devices may be preferably positioned adjacent the path of travel of the cans and on either side of the longitudinal path of the machine. These chains 58 will carry a plurality of lugs 59 which are designed to space the array to be packaged a distance sufficient to register with the spacing required between the jaw stations 52. In order to insure that the arrays are clearly aligned with the jaw stations, the lug chain system 58 is designed to rotate at approximately the same speed as the speed of jaw conbeyor 18, however, the conveyor 20 carrying the cans or arrays to be packaged is moving at a slightly greater speed than the associated linear speed of the jaw station immediately above this conveyor. As a result of the combination effect of difference in speed of the conveyor 20 and chain 58 the arrays will abut against the lugs 59 to insure proper registration of the array with the stretched carrier continuously carried above each array.

Since the band 70 is stretched significantly, there will be a great deal of friction between jaw members 54 and the stretched devices. Even though these jaws could be highly polished a positive stripping means must be used to disassociate the bands from the jaws when they have been properly positioned about the array. Each lug carrying chain 58 also carries a plurality of stripping arms 60 equal in number to the number of lugs. These stripping arms 60 are shown to be designed to contact the upper edge of the band 70 and gradually pivot to push the band down relative to the top of the cans. The pivoting is positively obtained by contact between a cam at the outer extremity of each arm 60 with a cam surface 62 fixed on the frame on both sides of the longitudinal path. This action is shown clearly in FIGS. 6–9 and represents a positive manner of disassociating the resilient elastic band from a jaw station into a similarly resilient stretched condition about the array in a positive manner.

The invention has shown the particular use with an array of 12 cans unitized in a $4\times3$ array. It should be apparent that two $6\times2$ arrays can be similarly associated by such a machine without departing from the spirit and intent of this invention.

It should also be appreciated that while the topmost conveyor system 16 provides an efficient control for associating the devices with the stretching jaws, this first conveyor may possibly be eliminated by careful feeding of the strip directly onto the jaw stations.

While specific embodiments of this invention are shown herein, it should be understood that various modifications and changes may occur to those skilled in the art and will be understood as forming a part of the present invention insofar as they fall within the spirit and scope of the appended claims.

We claim:

1. A method of creating a multi-package for cans, or the like, including the steps of;

arraying a plurality of containers in rank and row configuration and assembling a primary package making device on a series of selected numbers of containers to create a series of sub-packages so that the containers in each sub-package so created are firmly arrayed and contained relative to one another, arranging a continuous roll of serially separable secondary packaging bands adjacent the sub-packages, positioning the separable bands loosely over a set of jaws which includes at least four jaws arranged so they form corners of an imaginary rectangle, moving the jaws linearly away from a longitudinal center line of the bands in a direction outwardly and at an angle to perpendicular from the center line, to open and slightly stretch the band without substantial movement of the jaws relative to the bands, moving the jaws and stretched band combination continuously over a continuously moving stream of sub-packages on a conveyor, the movement of the jaws, with stretched bands, being both longitudinally relative to the movement of the containers and downwardly onto telescopic association over the arrayed sub-packages.

2. The method of claim 1 wherein the sub-packages are continuously moving through an assembly region in a first direction and the bands positioned over the jaws move first in a second, opposite direction, and secondly, change their movement to travel in the same first direction as the movement of the sub-packages.

3. The method of claim 2 wherein the conveyor is moved in said first direction at a slightly greater speed than the movement of the jaws, as said jaws move in the same direction as the subpackages.

4. Method of claim 3 wherein the arrays of sub-packages are retarded slightly so that they move at substantially identical speed to the speed of movement of the jaws carrying the bands.

* * * * *